United States Patent [19]

Matidori et al.

[11] 4,451,430

[45] May 29, 1984

[54] METHOD OF PRODUCING COPPER ALLOY BY MELTING TECHNIQUE

[75] Inventors: Seika Matidori; Koichi Teshima, both of Tokyo; Masato Sakai, Yokohama, all of Japan

[73] Assignee: Tokyo Shibaura Denki Kabushiki Kaisha, Kawaski, Japan

[21] Appl. No.: 534,634

[22] Filed: Sep. 23, 1983

Related U.S. Application Data

[63] Continuation of Ser. No. 374,910, May 4, 1982, abandoned, which is a continuation of Ser. No. 175,014, Aug. 7, 1980, abandoned.

[30] Foreign Application Priority Data

Aug. 7, 1979 [JP] Japan ..... 54-99884

[51] Int. Cl.[3] ..... C22C 1/06; C22C 9/00

[52] U.S. Cl. ..... 420/492

[58] Field of Search ..... 420/492, 495; 75/135, 75/153

[56] References Cited

U.S. PATENT DOCUMENTS

| | | | |
|---|---|---|---|
| 3,143,442 | 8/1964 | Watts | 75/153 |
| 3,194,655 | 7/1965 | Pels et al. | 75/153 |
| 3,357,824 | 12/1967 | Saarivirta | 75/153 |
| 3,392,016 | 7/1968 | Opie et al. | 75/153 |
| 3,639,119 | 1/1972 | McLain | 75/153 |
| 3,928,028 | 12/1975 | Yarwood | 75/154 |
| 4,330,328 | 5/1982 | Tyler et al. | 420/492 |

OTHER PUBLICATIONS

Copper-Base Alloys Foundry Practice, Third Edition, 1965, American Foundrymen's Society, Des Plaines, Ill., pp. 8–14.

*Primary Examiner*—Peter K. Skiff

*Attorney, Agent, or Firm*—Cushman, Darby & Cushman

[57] ABSTRACT

A copper alloy is produced by introducing copper base metal in a crucible, i.e. part of the metal copper is put in the crucible after introduction of the additives into the crucible for rapidly cooling the melt to a casting temperature.

7 Claims, No Drawings

METHOD OF PRODUCING COPPER ALLOY BY MELTING TECHNIQUE

This is a continuation of application Ser. No. 374,910 filed May 4, 1982; which is a continuation of Ser. No. 175,014 filed Aug. 7, 1980 both now abandoned.

BACKGROUND OF THE INVENTION

This invention relates to a method of producing a copper alloy by means of melting under the air atmosphere.

In the production of a copper alloy, it was customary to employ a vacuum melting method for effectively removing the gas components such as oxygen from the alloy system. But, the vacuum melting method necessitates special equipments such as an evacuator for evacuating the melting furnace, with the result that the alloy-producing apparatus is rendered complex and the manufacturing cost of the alloy is increased.

SUMMARY OF THE INVENTION

An object of this invention is to provide a method of producing a copper alloy by means of melting under the air atmosphere. Another object is to provide a method of producing a copper alloy without using special equipments as in the conventional vacuum melting method, thereby reducing the manufacturing cost of the alloy.

According to this invention, there is provided a method of producing a copper alloy comprising the steps of melting a major portion of a metal copper within a crucible put under the air atmosphere; introducing the additives into the crucible; and adding the remaining portion of the metal copper to the melt for rapidly cooling the melt to a casting temperature.

There is also provided a method of producing a copper alloy in which an effective deoxidation can be attained.

DETAILED DESCRIPTION OF THE PREFERRED EMBODIMENT

The present inventors have found that it is possible in the production of copper alloys to effectively alloy, even in air atmosphere, an additive element or elements which have a higher melting point than that of copper and are highly oxidizable. Conventionally such copper alloys are usually produced by means of vacuum melting method and degassing with the addition of an additive is controlled for example by Ar gas. According to the present invention, it has been made possible to produce copper alloys almost equivalent in quality to that produced by a vacuum melting method by fully deoxidizing copper alloys after being molten and by shortening the cooling time of from a temperature at which additives are added to a casting temperature. The present inventors have also found that the deoxidation of copper alloys is further promoted by the utilization of a carbon crucible.

In this invention, a major portion of the base metal copper, i.e., 85 to 95% by weight of the total copper content, is melted first within a carbon crucible put under the air atmosphere, followed by introducing the additives into the crucible. Then, the remaining metal copper is added to the melt for rapidly cooling the melt to a casting temperature. The amount of the metal copper added to the melt should be 5 to 15% by weight, preferably, about 10% by weight. It is important to use a base metal copper which scarcely contains oxygen. For example, an electrolytic copper is suitable for use as the base metal copper. The melt is quenched, i.e., rapidly cooled, by the addition of the remaining metal copper from 1,200°-1,250° C. at which the additives are added to a casting temperature of 1,100°-1,150° C. within a period of only 1-2 minutes.

The method of this invention is particularly advantageous in the production of a chrome-copper alloy, a zirconium-copper alloy, a chrome-zirconium-copper alloy, etc. chrome should preferably be added in the form of a chrome-copper alloy. Specifically, chrome widely differs from copper in melting point. In addition, chrome is rather difficult to form a solid solution with copper and metal chrome added to a molten copper tends to be segregated. It may be preferable to employ a material having a higher melting point than copper and being easily, oxidizable, e.g. zirconium may be added for solely deoxidizing the melt or as an alloy component. The zirconium acting as an alloy component should be added separately from the zirconium used for the deoxidation purpose. Specifically, the alloy component zirconium should be added after a sufficient deoxidation of the melt performed by the zirconium added first. In general, zirconium should be added at a temperature higher than the melting temperature employed in the ordinary method of producing a copper alloy.

For producing a chrome-zirconium-copper alloy, a chrome-copper alloy is introduced first into a carbon crucible housing a molten metal copper, e.g., molten electrolytic copper. Then, one portion of zirconium is added for deoxidizing the melt, followed by adding the remaining portion of zirconium as an alloy component. Since, zirconium is easy to be oxidized, it is necessary to add the alloy component zirconium after sufficient deoxidation of the melt. Otherwise, the alloy component zirconium fails to be dispersed uniformly within the melt.

The copper alloy produced by the method of this invention may also contain traces of silicon, germanium, magnesium, boron, etc. For producing such an alloy, the special component mentioned should be added after the deoxidation treatment by zirconium. The addition of the special components to a sufficiently deoxidized melt leads to a high yield of the product alloy. Incidentally, boron, if added, should be added in the form of a boron-chrome alloy.

The copper alloy produced by the method of this invention is substantially equal in quality to that produced by the conventional vacuum melting method. Specifically, the method of this invention produces prominent effects as summarized in the following:

1. A copper alloy can be produced without using a special additive.
2. Inclusion of impurities can be effectively prevented.
3. Additives can be effectively alloyed with copper.
4. Segregation of additives can be effectively prevented.

To reiterate, a melt is prepared in the present invention within a carbon crucible put under the air atmosphere, rendering it unnecessary to use the special equipment used in the vacuum melting method. Naturally, the method of this invention permits reducing the manufacturing cost of the alloy.

This invention produces particularly prominent effects when employed for the production of Cr-Cu alloys, e.g., 0.05 to 1.5 wt% Cr-Cu, preferably, 0.3 to 1.5 wt% Cr-Cu, more preferably, 0.3 to 0.9 wt% Cr-Cu; Zr-Cu alloys, e.g., 0.05 to 0.5 wt% Zr-Cu, preferably, 0.1 to 0.5 wt% Zr-Cu, more preferably, 0.1 to 0.4 wt% Zr-Cu; and Cr-Zr-Cu alloys, e.g., 0.3 to 1 wt% Cr-0.1 to 0.5 wt% Zr-Cu. Further, 0.005 to 0.1 wt%, preferably, 0.01 to 0.03 wt% of silicon, germanium, boron and/or magnesium may be added to the copper alloys mentioned above.

EXAMPLE

A Cr-Zr-Cu alloy was actually produced by the method of this invention.

Specifically, 83 g of electrolytic copper was put in a carbon crucible put under the air atmosphere and heated at 1,080° to 1,150° C. so as to melt the copper. Then, 7 kg of 10% Cr-Cu alloy and 100 g of cryolite acting as a flux were added to the melt followed by further heating the melt to 1,200° to 1,250° C. and adding 100 g of zirconium for deoxidizing the heated melt. After mixing and removing the slag from the melt thereby fully deoxidizing the melt, Si, Ge, Mg, etc. were added to the melt, followed by further adding 350 g of zirconium to the melt. Then, 10 kg of electrolytic copper was added to the melt for rapidly cooling the melt to 1,100° to 1,150° C. During the rapid cooling step, a flux was added to the melt and the slag was removed from the melt. Finally, the melt was cast into a desired shape.

The produced Cr-Zr-Cu alloy was found to be substantially equal in quality to the alloy produced by the conventional vacuum melting method.

What we claim is:

1. A method of producing a zirconium-containing alloy by melting copper, together with other alloying ingredients, in an air atmosphere, and adding the zirconium in two separate steps to assure uniform dispersion within the melt, said method comprising the successive steps of:

(a) melting from about 85 to about 95% by weight of copper of the total copper content in a crucible in air;

(b) introducing only zirconium in at least a deoxidizing amount to the copper melt; thereafter (c) introducing an alloying amount of zirconium to the substantially deoxidizing melt of step (b), thereby dispersing the thus added zirconium uniformly throughout the melt; and (d) adding the remaining amount of copper of about 5 to about 15% by weight to the melt, thereby rapidly cooling the melt to a casting temperature and minimizing the loss of zirconium added in step (b), the melt being substantially exposed to an air atmosphere during steps (a), (b), (c) and (d).

2. The method according to claim 1 wherein the alloy produced is a chrome-zirconium-copper alloy.

3. The method according to claim 1 wherein the alloy contains 0.3 to 1% by weight of Cr and 0.1 to 0.5% by weight of Zr.

4. The method according to claim 1 wherein the melting is conducted in a carbon crucible.

5. The method of claim 1 wherein there is added after step (b) from 0.005 to 0.1% by weight of at least one additive selected from the group consisting of silicon, germanium, magnesium and boron.

6. The method according to claim 1 wherein the alloy is Zr-Cu.

7. The method according to claim 6 wherein the Zr-Cu alloy contains about 0.05 to about 0.5% by weight Zr.

* * * * *